US011603720B2

(12) United States Patent
Chai et al.

(10) Patent No.: US 11,603,720 B2
(45) Date of Patent: Mar. 14, 2023

(54) METHODS FOR TRIPPING A DRILLING RIG OR A WORKOVER RIG

(71) Applicant: SICHUAN HONGHUA PETROLEUM EQUIPMENT CO., LTD., Sichuan (CN)

(72) Inventors: Junqing Chai, Guanghan (CN); Yan Lyu, Guanghan (CN); Liangliang Liang, Guanghan (CN); Aimin Tang, Guanghan (CN); Zhenghua Wu, Guanghan (CN)

(73) Assignee: SICHUAN HONGHUA PETROLEUM EQUIPMENT CO., LTD., Guanghan (CN)

( * ) Notice: Subject to any disclaimer, the term of this patent is extended or adjusted under 35 U.S.C. 154(b) by 0 days.

(21) Appl. No.: 17/381,221

(22) Filed: Jul. 21, 2021

(65) Prior Publication Data

US 2022/0074275 A1 Mar. 10, 2022

(30) Foreign Application Priority Data

Sep. 4, 2020 (CN) ..... 202010920022.5
Sep. 4, 2020 (CN) ..... 202010920272.9

(51) Int. Cl.
*E21B 19/14* (2006.01)
*E21B 19/16* (2006.01)
*E21B 44/02* (2006.01)

(52) U.S. Cl.
CPC ..... *E21B 19/165* (2013.01); *E21B 19/14* (2013.01); *E21B 44/02* (2013.01)

(58) Field of Classification Search
CPC ..... E21B 19/14; E21B 19/165; E21B 44/02
See application file for complete search history.

(56) References Cited

U.S. PATENT DOCUMENTS 7,163,335 B2 * 1/2007 Dishaw ..... E21B 19/165 374/121
2007/0284116 A1 * 12/2007 Hall ..... E21B 47/01 166/243

(Continued)

FOREIGN PATENT DOCUMENTS

CN 102071887 A 5/2011
CN 201982029 U 9/2011

(Continued)

OTHER PUBLICATIONS

First Office Action in Chinese Application No. 202010920272.9 dated Jun. 1, 2021, 9 pages.

*Primary Examiner* — Christopher J Sebesta
(74) *Attorney, Agent, or Firm* — Metis IP LLC

(57) ABSTRACT

The present disclosure provides a method for running a drilling rig or a workover rig including a plurality of stands into a wellbore. In step 1, position information of the stands in a finger board area may be recorded with a control system. In step 2, the stands may be placed. In step 3, a position of a traveling block may be adjusted so as to move a power elevator to a second waiting position of a racking platform. In step 4, the stands may be pushed with the pipe racking device. In step 5, the second stand may be moved and stabbed in the first stand with an iron floor man. In step 6, a joint between the first stand and the second stand may be made up. In step 7, the traveling block may be moved downward. In step 8, the traveling block may be moved upward.

10 Claims, 3 Drawing Sheets

(56) References Cited

U.S. PATENT DOCUMENTS

| | | | | |
|---|---|---|---|---|
| 2013/0275100 | A1* | 10/2013 | Ellis | B25J 19/023 703/2 |
| 2016/0160586 | A1 | 6/2016 | Keogh et al. | |
| 2017/0306710 | A1* | 10/2017 | Trydal | G06K 9/78 |
| 2017/0362905 | A1* | 12/2017 | Mailly | G06K 9/6269 |
| 2018/0238127 | A1* | 8/2018 | Berry | E21B 19/24 |
| 2019/0078401 | A1* | 3/2019 | Knowlton | E21B 47/00 |
| 2019/0119996 | A1* | 4/2019 | Ly | E21B 19/161 |
| 2020/0394779 | A1* | 12/2020 | Ayanambakkam | G06K 9/6215 |

FOREIGN PATENT DOCUMENTS

| | | | |
|---|---|---|---|
| CN | 203716877 | U | 7/2014 |
| CN | 105275415 | A | 1/2016 |
| CN | 105761445 | A | 7/2016 |
| CN | 206360649 | U | 7/2017 |
| CN | 206769848 | U | 12/2017 |
| CN | 109356537 | A | 2/2019 |
| CN | 109667554 | A | 4/2019 |
| CN | 110043203 | A | 7/2019 |
| CN | 110454100 | A | 11/2019 |
| CN | 111535758 | A | 8/2020 |
| WO | 2002014648 | A1 | 2/2002 |
| WO | 2011135311 | A2 | 11/2011 |

* cited by examiner

METHODS FOR TRIPPING A DRILLING RIG OR A WORKOVER RIG

CROSS-REFERENCE TO RELATED APPLICATIONS

The present disclosure claims priority to Chinese Application No. 202010920272.9, filed on Sep. 4, 2020, and Chinese Application No. 202010920022.5, filed on Sep. 4, 2020, the contents of which are hereby incorporated by reference.

TECHNICAL FIELD

The present disclosure relates to methods for tripping a drilling rig or a workover rig, in particular, relates to methods for tripping an oil drilling rig or an oil workover rig.

BACKGROUND

During oil and gas extraction, a drilling pipe of a drilling rig or a workover rig is generally long and bulky. For example, a 10 meters (m) long φ127 mm drill pipe may weigh up to 300 kilograms (kg). If the φ127 mm drill pipe slips during an operation, people might be injured. The safety incidents relating to the drilling rig or the workover rig often occur during well center work.

At present, the processing system for the drilling rig or the workover rig generally includes a push type iron floor man, a push-support pipe racking device on a finger board, a top drive, a power elevator, a power slip, pipe guiding arm and an iron roughneck, etc. The processing method, however, still stays in a mechanization or semi-mechanization stage. The method for processing the drilling rig or the workover rig is generally conducted step-by-step, that is, during the processing method, the operations are performed in sequence. In addition, jointing two or more devices may require a large number of manual operations and require a manual confirmation, which greatly reduces the efficiency for processing the drilling pipe and resulting in safety risks for the operators. Therefore, it is desirable to develop methods for tripping the drilling rig or the workover rig, thereby improve automation, reduce a lot of manual operations, and reduce safety risks for an operator.

SUMMARY

The present disclosure intends to provide methods for tripping a drilling rig or a workover rig, which may achieve automation, reduce a lot of manual operations, and reduce safety risks for an operator.

According to one aspect of the present disclosure, a method for running a drilling rig or a workover rig into a wellbore is provided. The drilling rig or the workover rig may include a plurality of stands. The method may include the following steps. In step 1, position information of the plurality of stands that are placed in a finger area may be recorded with a control system. A pipe racking device may be placed in a first waiting position. In step 2, the stands may be placed. A first stand of the plurality of stands may be placed in a well center and a second stand of the plurality of stands may be grabbed from the finger board area. In step 3, a position of a traveling block may be adjusted so as to move a power elevator to a second waiting position of a racking platform. In step 4, the stands may be pushed with the pipe racking device. Relative position information regarding the power elevator and the second stand may be obtained using a machine vision technique. An upper end of the second stand may be pushed to the power elevator with the pipe racking device through the control system by automatically adjusting a position of a tong body of the pipe racking device. In step 5, the second stand may be moved and stabbed in the first stand with an iron floor man. The second stand may be grabbed, and a bottom end of second stand may be stabbed in an upper end of the first stand that is placed in the well center with the iron floor man. In step 6, a joint between the first stand and the second stand may be made up. An iron roughneck may be extended. Position information of the iron roughneck may be obtained using the machine vision technique. Position information of the joint between the first stand and second stand may be obtained using the machine vision technique. A height of a tong body of the iron roughneck may be made match a height of the joint through the control system by automatically adjusting the height of the tong body of the iron roughneck. The joint between the first stand and second stand may be made up by using the control system to automatically adjust a make-up torque. In step 7, the traveling block may be moved downward. In step 8, the traveling block may be moved upward. Relative position information of the power elevator and a stand may be obtained using a position detection technique or the machine vision technique. The control system may be used to disengage the power elevator from the stand, thereby moving the traveling block upward to the second waiting position of the racking platform.

The method for running the drilling rig or the workover rig into the wellbore may achieve automation, thereby improving the efficiency for handling the stands. Moreover, by using the machine vision technique and the position technique, a lot of manual operations may be reduced, thereby avoiding the operator from confirming stand jointing (e.g., stabbing the second stand in the first stand, making up the joint between the first stand and the second stand) on the spot and reducing safety risks for the operator.

In some embodiments, the step 4 may further include making the second stand enter into the power elevator by using the control system to make one or more minor adjustments to an open direction of the power elevator by simultaneously applying the position detection technique and the machine vision technique. By applying the position detection technique, the power elevator may match a tong body of the pipe racking device, which ensures a position accuracy of the second stand in the power elevator, make the second stand enter the power elevator, and improve the automation of the method.

In some embodiments, the step 5 may further include obtaining position information of the second stand in a placement area, and automatically recording a sequence number of the second stand and the position information of the second stand in the placement area. The placement area may include the finger board area and a set back area. In this way, after finishing the method for running the drilling rig or the workover rig into the wellbore, each stand of the plurality of stands may be moved back to its original position in the placement area, where the stand is placed before being run into the wellbore. In a next process for running the plurality of stands into the wellbore, according to the record information, the plurality of stands may be grabbed accurately and then be placed in the wellbore. Grabbing the plurality of stands accurately refers to that in different processes for running the plurality of stands into the wellbore, the orders in which the plurality of stands are run into the wellbore may be the same.

In some embodiments, when finishing the step 5, the pipe racking device, may be moved to a stand-by position for a next stand. When conducting the step 6, the iron floor man may be moved to a stand-by position for the next stand, the pipe racking device may be made grab the next stand, and the next stand may be made before the step 8, simultaneously. When finishing the step 6, the iron roughneck may be moved to a parking position. In this way, various devices may work at the same time, which may improve work efficiency and reducing work time.

In some embodiments, the stand may be continually run into the wellbore by repeatedly performing the steps 4-8, which may achieve full automation in running the plurality of stands into the wellbore.

According to another aspect of the present disclosure, a method for pulling a drilling rig or a workover rig out of a wellbore is provided. The drilling rig or the workover rig may include a plurality of stands. The method may include the following steps. In step 1, a first stand of the plurality of stands may be grabbed. When a power elevator contacts a step surface of the stand, the power elevator may be turned off to seize the first stand. In step 2, a traveling block may be moved upward. In step 3, the first stand and a second stand of the plurality of stands may be broken out. A bottom end of the first stand may be stabbed in an upper end of the second stand, and a joint between the first stand and the second stand may be made up. Position information of a tong body of an iron roughneck may be obtained using a machine vision technique. Position information of the joint between the first stand and the second stand may be obtained using the machine vision technique. A height of the tong body of the iron roughneck may be made match a height of the joint between the first stand and the second stand, through the control system automatically adjusting the height of the tong body of the iron roughneck. The first stand and the second stand may be broken out. Meantime, position information of the first stand and the second stand may be obtained using the machine vision technique and transmitting to the control system. The control system may determine whether the first stand and the second stand are broken out through the control system. In step 4, the first stand may be grabbed and placed with an iron floor man. The first stand may be grabbed and a bottom end of the first stand may be placed to a set back area with the iron floor man. In step 5, the first stand may be grabbed and placed with a pipe racking device to a finger board area. The first stand may be grabbed with the pipe racking device. Relative position information regarding the first stand and a tong body of the pipe racking device may be obtained. An upper end of the first stand may be moved to the finger board area through the control system automatically adjusting a position of the tong body of the pipe racking device. In step 6, the traveling block may be moved downward. Position information of a power elevator link may be obtained using a position detection technique or the machine vision technique. The traveling block may be moved downward through the control system controlling an angle of inclination of the power elevator link, so as to grab a next stand.

The method for pulling the drilling rig or the workover rig out of the wellbore may achieve automation, thereby improving the efficiency for handling the stands. Moreover, by using the machine vision technique and the position technique, a lot of manual operations may be reduced, thereby avoiding the operator from confirming stand jointing on the spot and reducing safety risks for the operator.

In some embodiments, the steps 4 and 5 may further include obtaining a sequence number of the first stand and position information of the first stand in the placement area by the control system, and using the machine vision technique, placing the first stand at a position corresponding to the sequence number and the position information of the first stand by using the control system to control the iron floor man and the pipe racking device. The placement area may include the finger board area and a set back area.

In some embodiments, the step 5 may further include making the pipe racking device grab the first stand firmly by using the control system to make one or more minor adjustments to an open direction of the power elevator by simultaneously applying the position detection technique and the machine vision technique.

In some embodiments, when conducting the step 4, the iron roughneck may be moved to a parking position. When conducting the step 5, the iron floor man may be moved to a stand-by position. When conducting the step 6, the pipe racking device may be moved to a parking position. In this way, various devices may work at the same time, which may improve the work efficiency and reducing work time.

In some embodiments, the stands may be continually pulled out of the wellbore by repeatedly performing the steps 1-6, which may achieve full automation in pulling the plurality of stands out of the wellbore.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities, and combinations set forth in the detailed examples discussed below.

DETAILED DESCRIPTION

Figure 1:
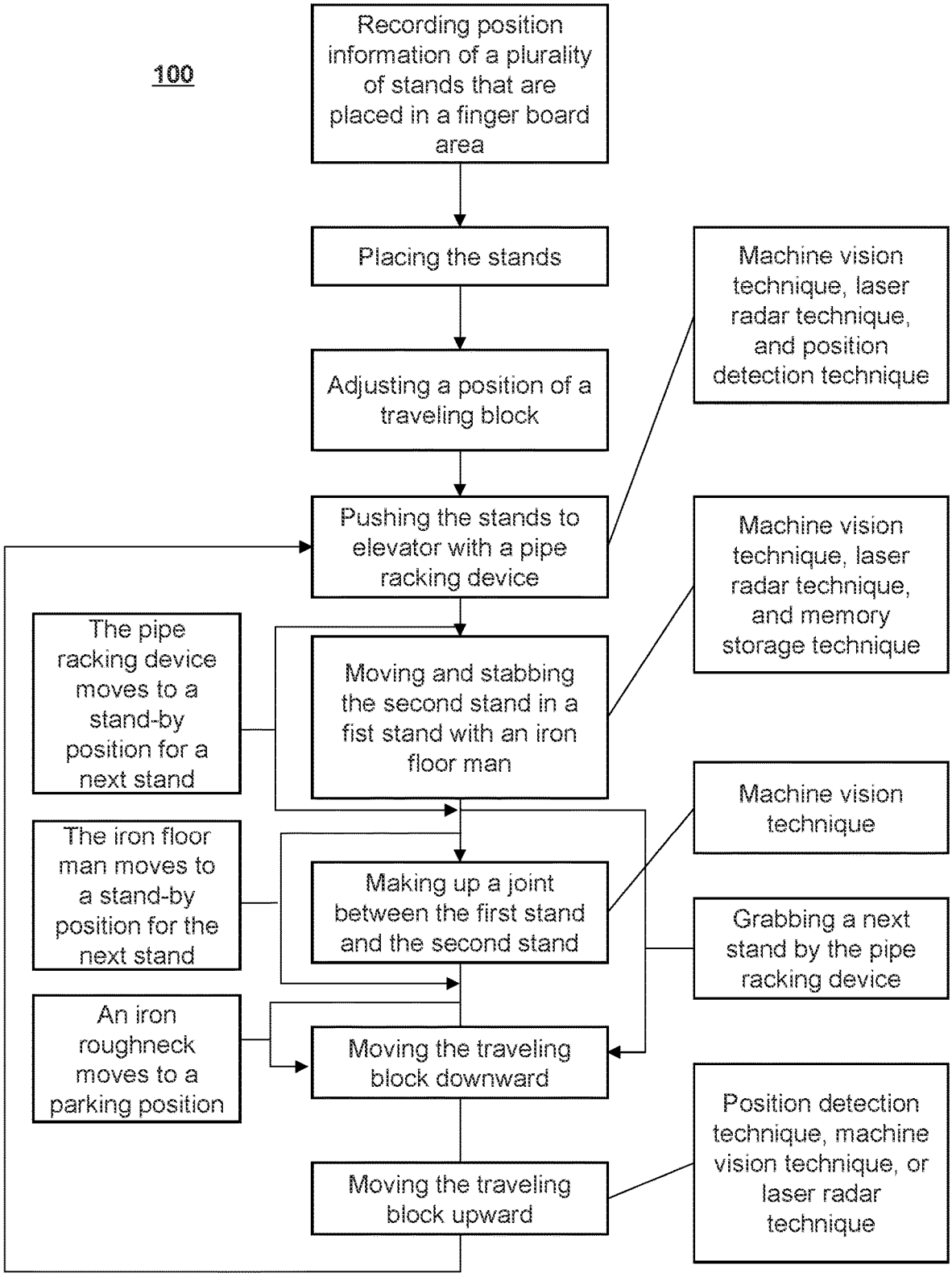
FIG. 1 is a block diagram illustrating an exemplary process for running a drilling rig or a workover rig into a wellbore according to some embodiments of the present disclosure.

In the following detailed description, numerous specific details are set forth by way of examples in order to provide a thorough understanding of the relevant disclosure. However, it should be apparent to those skilled in the art that the present disclosure may be practiced without such details. In other instances, well-known methods, procedures, systems, components, and/or circuitry have been described at a relatively high-level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but to be accorded the widest scope consistent with the claims.

The terminology used herein is for the purpose of describing particular example embodiments only and is not intended to be limiting. As used herein, the singular forms "a," "an," and "the" may be intended to include the plural forms as well, unless the context clearly indicates otherwise. It will be further understood that the terms "comprise," "comprises," and/or "comprising," "include," "includes," and/or "including," when used in this specification, specify the presence of stated features, integers, steps, operations, elements, and/or components, but do not preclude the presence or addition of one or more other features, integers, steps, operations, elements, components, and/or groups thereof.

It will be understood that the terms "system," "device, "assembly," "component," etc., when used in this disclosure, refer to one or more parts with one or more specific purposes. However, a structure that may perform a same or similar function compared to a part exemplified above or referred to elsewhere in the present disclosure may be named differently from the present disclosure.

In the present disclosure, spatial reference terms such as "center," "longitudinal," "transverse," "length," "width," "thickness," "upper," "lower," "front," "back," "left," "right," "vertical," "horizontal," "top," "bottom," "inner," "outer," "clockwise," "counterclockwise," "axial," "radial," "circumferential," etc., indicate, in a relative sense, an orientation or positional relationship between two or more elements, assemblies, devices, or systems based on an orientation or positional relationship as shown in the drawings, and are only for the convenience and simplicity of description, rather than indicating or implying that the elements, assemblies, devices or systems in the present disclosure have a particular orientation when the disclosed system, or a portion thereof, is in operation, or are constructed and operated in a particular orientation, and therefore may be not understood as a limitation of the present disclosure.

It will be understood that, although the terms "first," "second," "third," etc., may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention.

In the present disclosure, unless otherwise clearly specified and limited, the terms "mount," "connect," "couple," "fix," "locate," "dispose," etc., should be understood in a broad sense, for example, it may be a fixed connection, a detachable connection, integrated into a whole, a mechanical connection, an electrical connection, directly connected, or indirectly connected via an intermediate medium, an internal connection of two elements, or an interconnection of two elements, unless otherwise clearly defined. For those skilled in the art, the specific meanings of the above terms in the present disclosure may be understood according to specific circumstances.

These and other features, and characteristics of the present disclosure, as well as the methods of operation and functions of the related elements of structure and the combination of parts and economies of manufacture, may become more apparent upon consideration of the following description with reference to the accompanying drawings, all of which form a part of this disclosure. It is to be expressly understood, however, that the drawings are for the purpose of illustration and description only and are not intended to limit the scope of the present disclosure. It is understood that the drawings are not to scale.

FIG. 1 is a block diagram illustrating an exemplary process for running a drilling rig or a workover rig into a wellbore according to some embodiments of the present disclosure. In some embodiments, process 100 may be implemented by a control system and a smart detection system to automatically monitor and control the drilling rig or the workover rig. The drilling rig or the workover rig may include a plurality of stands (e.g., a stand 330 shown in FIG. 3). As used the process 100, a first stand and a second stand may be any two jointed stands of the plurality of stands, wherein a bottom end of the second stand is stabbed in an upper end of the first stand and a joint between the first stand and the second stand is made up. In some embodiments, the smart detection system may include but not limited to a machine vision system, a laser radar system, and a millimeter-wave radar system. In some embodiments, the process 100 may include the following steps.

In step 1, position information of the plurality of stands that are placed in a finger board area may be recorded with a control system, and a pipe racking device (e.g., a pipe racking device shown in FIG. 3) may be placed in a first waiting position.

In some embodiments, the pipe racking device may push the stand to the finger board area. The control system may record the position information of each stand of the plurality of stands. The pipe racking device may be at the first waiting position. In some embodiments, the position information of a stand may include a space coordinate, a relative coordinate, a preset line number and a preset column number of the stand in a placement area, or the like. In some embodiments, the placement area may include the finger board area and a set back area, wherein an upper end of a stand may be pushed to the finger board area, and a bottom end of the stand may be pushed to the set back area. Taking the preset line number and the preset column number as an example, the position information of the stand may be represented as (5, 6), wherein "5" representing the line number and "6" representing the column number of the stand.

Figure 3:
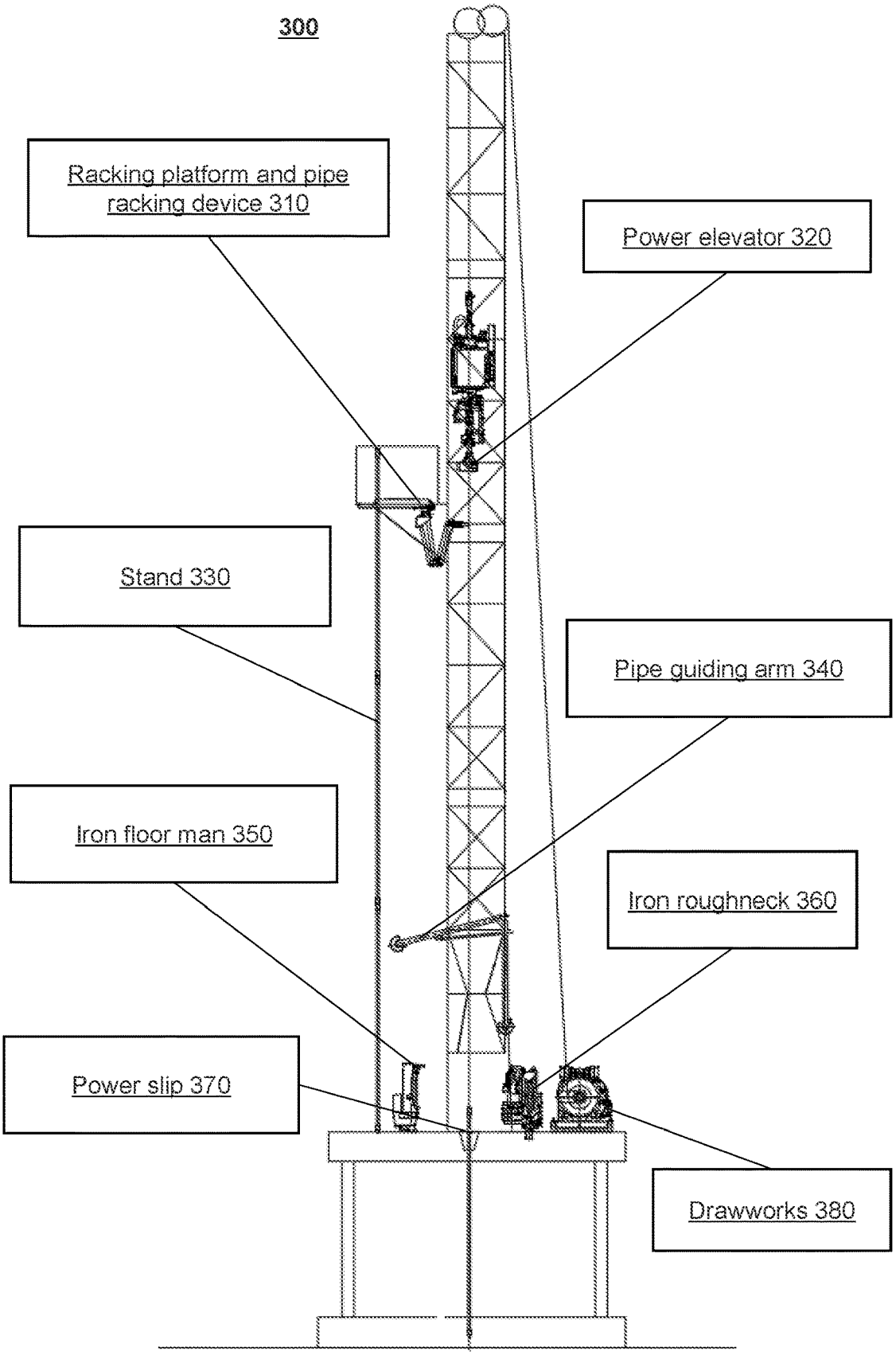
FIG. 3 is a schematic diagram illustrating an exemplary drilling rig according to some embodiments of the present disclosure.

In some embodiments, the smart detection system may include a first smart detection module which is provided on a mast and close to a racking platform (e.g., a racking platform shown in FIG. 3). In some embodiments, "being close" refers to that a distance between two components or modules is less than a threshold (e.g., 10 centimeters (cm), 20 cm, 50 cm, 1 m). The first smart detection module may include but not limited to an image acquisition device, a laser radar, and a millimeter-wave radar. For example, the first smart detection module may include a camera. The first smart detection module may observe a count of and the position information of the plurality of stands in the placement area, and transmit an observation result to the control system. In some embodiments, the control system may number the stands according to the position information of the plurality of stands, for example, according to a sequence along a certain direction, according to a sequence of the plurality of stands being placed into the placement area. In some embodiments, the first smart detection model may include two or more detection lenses (or a laser radar, a millimeter-wave radar), which are disposed around the placement area. For example, both a top and a bottom of the racking platform may be provided with one detection lens.

In some embodiments, the control system may record a sequence number and the position information of each stand, which may distinguish the plurality of stands, thereby making the pipe racking device grab the stand correctly.

In step 2, the plurality of stands may be placed. In some embodiments, a first stand of the plurality of stands may be placed in a well center and a second stand of the plurality of stands may be grabbed from the finger board area.

The first stand refers to any stand other than a last stand among the plurality of stands. The second stand refers to a stand which is run into the wellbore next to the first stand.

In some embodiments, before the step 2, the pipe racking device in the first waiting position may grab the first stand. In some embodiments, the control system may determine the sequence number and position information of the first stand. The first smart detection module may obtain a relative position regarding the pipe racking device and the first stand, and transmit the relative position to the control system. In some embodiments, the control system may automatically adjust a position trajectory of the pipe racking device in the first waiting position to correspond to a stand area where the first stand is located. In some embodiments, the stand area of the first stand may be a circular range around the first stand, for example, a circular area within a radius of 20 cm from the center of the first stand. In some embodiments, after the pipe racking device moves to a stand area of a stand, the first smart detection module may accurately identify the position of the stand and control the pipe racking device to accurately grasp the stand. For example, when the pipe racking device moves to the stand area of the first stand, the first smart detection module may adjust a focal length of the image acquisition device to make the observed pipe racking device and first stand clearer, so as to control the pipe racking device to accurately grasp the first stand.

When the first stand is removed from the placement area, the control system may record the sequence number and the position information of the first stand.

In some embodiments, the pipe racking device may move the first stand to above a well center. In some embodiments, the pipe racking device may place the first stand in the well center and turn off a power slip (e.g., a power slip 370 shown in FIG. 3) to fix the first stand in the well center. In some embodiments, after the pipe racking device moves the first stand to the well center, the first stand may be handed over to a power elevator (e.g., a power elevator 320 shown in FIG. 3). The power elevator may push the first stand into the well center. After the pipe racking device moves the first stand, the control system makes the pipe racking device grab the second stand from the finger board area.

In some embodiments, the machine vision system may include a second smart detection module arranged on a side surface of the well center. In some embodiments, the second smart detection module and an iron roughneck may be located on two opposite sides on the outside surface of the well center, respectively. In some embodiments, the second smart detection module may also be provided on a component or a structure of the iron roughneck, for example, on a tong body of the iron roughneck. In some embodiments, the second smart detection module may also be installed on other devices near the well center. The second smart detection module may identify relative position information regarding the first stand and the well center, and the control system may adjust a movement trajectory of the pipe racking device according to the relative position information, so that the pipe racking device places the first stand in the well center. Then the power slip may be turned off to seize the first stand firmly.

In some embodiments, the second smart detection module may include but not limited to, an image acquisition device, a laser radar, and a millimeter-wave radar. In some embodiments, the second smart detection module may be the laser lidar, which may detect parameters such as a distance, an orientation, and a gesture between the first stand and the well center, so as to adjust the position of the pipe racking device to place the first stand in the well center. In some embodiments, the second smart detection module may be a millimeter-wave radar, which has a similar mechanism to that of the laser lidar, but has better clarity and accuracy. In some embodiments, the second smart detection module may also be a combination of the image acquisition device, the laser radar, and the millimeter-wave radar, which may collect information relating to the first stand from different angles, thereby improving the controlling accuracy.

In some embodiments, since the plurality of stands may be connected continuously, when step 2 is performed, the stand in the well center may be regarded as the first stand.

In some embodiments, the pipe racking device may grab the second stand from the finger board area. When grabbing the second stand, the first smart detection module may determine position information of the second stand and transmit it to the machine vision system. The machine vision system may control the pipe racking device to accurately grab the second stand in the finger board area. More descriptions regarding the grabbing the second stand with the pipe racking device may be referred to the grabbing of the first stand, and are repeated herein.

In step 3, a position of a traveling block may be adjusted so as to move the power elevator to a second waiting position of a racking platform.

In some embodiments, the control system may control the traveling block to move upward, so that the power elevator rises from the well center to the second waiting position. The second waiting position refers to a position that may be docked with the stand grabbed with the pipe racking device. For example, the second waiting position may be above the well center. A height of the second waiting position may be the same as or similar to a height of a finger board of the stand in the finger board area (for example, a height difference therebetween is within ±20 cm). In some embodiments, due to a movement error of the power elevator, the second waiting position of the power elevator every time may be different.

In some embodiments, the machine vision system may further include a third smart detection module arranged on the mast. The third smart detection module may be used to observe a relative distance regarding a drilling device such as the traveling block and the power elevator and a pipe guiding arm (e.g., a pipe guiding arm 340 shown in FIG. 3), so as to ensure a safe operation of the traveling block. In some embodiments, the third smart detection module may include but not limited to an image acquisition device, a laser lidar, and a millimeter-wave radar.

In some embodiments, the machine vision system may be used to determine a minimum value of the relative distance with the third smart detection module. The interference between the traveling block and the pipe guiding arm may be avoided by adjusting a position of the traveling block and/or a position of the pipe guiding arm. For example, the relative distance between the traveling block and the pipe guiding arm may be controlled to be greater than a preset threshold (e.g., 20 cm). Therefore, the present disclosure may avoid manually confirming whether the traveling block will collide with the pipe guiding arm, thereby reducing a safety hazard to the operator, improving the efficiency for handling the stand, improving the system's automatic control performance, and ensuring a safe operation of the traveling block.

In step 4, the plurality of stands may be pushed with the pipe racking device. In some embodiments, relative position information of the power elevator and the second stand may be obtained using a machine vision technique. An upper end of the second stand may be pushed to the power elevator with the pipe racking device through the control system by automatically adjusting a position of a tong body of the pipe racking device.

The machine vision technique refers to applying a machine vision system to a processing system of the drilling rig or the workover rig to automate the processing system.

In some embodiments, the pipe racking device may push the upper end of the second stand to the power elevator in the waiting position, and then turn off the power elevator. The relative position information of the power elevator and the second stand may be obtained using the machine vision technique.

In some embodiments, the machine vision system may include a fourth smart detection module arranged above the racking platform. The fourth smart detection module may collect the relative position information of the power elevator and the second stand, and transmit the relative position information to the control system. The control system may automatically adjust a position of the tong body of the pipe racking device based on the relative position information of the power elevator and the second stand, so that the pipe racking device may accurately push the upper end of the second stand to the power elevator, thereby avoiding safety risks for an operator and reducing work time.

In some embodiments, the upper end of the second stand refers to an upper section of the second stand. In some embodiments, due to factors such as a length of the stand or a movement error of the pipe racking device, the position of the upper end of the stand into the power elevator may be different. For example, a top 0.5 m section of an upper end of the first stand may enter into the power elevator, and a top 0.4 m section of the upper end of the second stand may enter into the power elevator.

In some embodiments, the fourth smart detection module may include but not limited to an image acquisition device, a laser radar, and a millimeter-wave radar. In some embodiments, the fourth smart detection module is a laser lidar. The laser lidar may include a laser transmitter and an optical receiver. The laser transmitter may emit laser toward the second stand and the power elevator. The optical receiver may receive light reflected from the second stand and the power elevator. The laser radar may detect a distance, an orientation, and a gesture between the second stand and the power elevator to adjust the position of the tong body of the pipe racking device, so that the pipe racking device may push the upper end of the second stand to the power elevator.

In some embodiments, the fourth smart detection module may be a millimeter-wave radar, which has a similar mechanism to that of the laser lidar. The millimeter-wave radar may send millimeter waves toward the second stand, determine the position and gesture of the second stand by receiving the reflected millimeter waves, and then adjust the movement trajectory of the pipe racking device or a position and/or an angle of the power elevator, so as to push the upper end of the second stand to the power elevator.

In some embodiments, the fourth smart detection module may also be a combination of the image acquisition device, the laser radar, and the millimeter-wave radar, which may collect information relating to the first stand from different angles, thereby improving the controlling accuracy.

Further, in order to ensure the accuracy of the position of the second stand in the power elevator and enable the second stand to enter the power elevator smoothly, in the step 4, one or more minor adjustments may be made to an open direction of the power elevator by simultaneously using the position detection technique and the machine vision technique, so as to make the second stand enter into the power elevator smoothly. In some embodiments, the position detection technique may include an acoustic rangefinder, a laser rangefinder, a Global Position System (GPS), or the like. In some embodiments, the machine vision detection technique may include an image recognition technique and so on. For example, the machine vision system may perform image recognition on an acquired image to determine whether the second stand grabbed with the pipe racking device enters into the power elevator smoothly.

In some embodiments, the fourth smart detection module may recognize the open direction of the power elevator and the direction of the second stand, and transmit it to the control system. The control system may be used to make one or more minor adjustments to the open direction of the power elevator until it faces toward the direction of the second stand, so that the second stand may enter the power elevator smoothly.

In step 5, the second stand may be moved and stabbed in the first stand with an iron floor man (e.g., an iron floor man 350 shown in FIG. 3). In some embodiments, the second stand may be grabbed, and a bottom end of the second stand may be stabbed in an upper end of the first stand the tis placed in the well center with the iron floor man.

The iron floor man may grab the second stand from a bottom end of the second stand, and then make the traveling block move upward for a certain distance, so that the bottom end of the grabbed second stand may be stabbed in the top end of the first stand that is placed in the well center.

In order to, after pulling a stand out of a wellbore, move the stand back to that the position (for brevity, also referred to as an original position) of the stand in the placement area before being run into the wellbore, the control system may record information (e.g., position information, a sequence number) relating to the stand after running the stand in the wellbore and before grabbing a next stand. In this way, in a next process for running the plurality of stands into the wellbore, according to the record information, the plurality of stands may be grabbed accurately and then be placed in the wellbore. Grabbing the plurality of stands accurately refers to that in different processes for running the plurality of stands into the wellbore, the orders in which the plurality of stands are run into the wellbore may be the same.

When running the stand in the wellbore, the control system may record the sequence number and position information of each stand of the plurality of stands. When pulling the stand out of the wellbore, the power elevator may transport the stand from the wellbore (e.g., the well center) to the finger board area in turn. The first smart detection module may determine the sequence number of the first stand and determine the original position of the stand based on the sequence number. According to the original position, the control system may control the pipe racking device to move back the stand to the original position. When pulling the stand(s) out of the wellbore, each stand may be moved back to its original position. For example, before being run into the wellbore, the first stand may be placed at a first position in the placement area (e.g., a position at the front of the placement area), and the second stand may be placed at a second position in the placement area (e.g., a position next to the first position). After being pulled out of the wellbore, the first stand may be moved back to the first position, and the second stand may be moved back to the second position.

The machine vision technique may be used to determine the position information of the second stand in the placement area. The control system may automatically record the sequence number and the position information of the second stand. The machine vision technique may include an image recognition technique, etc. In some embodiments, the first smart detection module may be used to determine the position information of the second stand in the placement area. When finishing the step 5, the pipe racking device may be moved to a stand-by position for a next stand, for example, moving the pipe racking device back to the first waiting position.

In step 6, the first stand and the second stand may be made up. In some embodiments, an iron roughneck (e.g., an iron roughneck 360 shown in FIG. 3) may be extended. Position information of the iron roughneck may be obtained using the machine vision technique. Position information of a joint between the first stand and second stand may be obtained using the machine vision technique. A height of a tong body of the iron roughneck may be made match a height of the joint through the control system by automatically adjusting the height of the tong body of the iron roughneck. The joint between the first stand and second stand may be made up by using the control system to automatically adjust a make-up torque.

After the iron floor man stabbing the bottom end of the second stand in the upper end of the first stand that is placed in the well center, the iron roughneck may be extended to make up the joint between the first stand and the second stand. The position information of the tong body of the iron roughneck may be obtained using the machine vision technique. In some embodiments, the second smart detection module of the machine vision system may transmit the position information of other drilling devices in the well center area to the machine vision system. The machine vision system may determine whether there is an intervention between the iron roughneck and the other drilling devices in a movement trajectory of the iron roughneck. The machine vision system may automatically adjust the movement trajectory of the iron roughneck to avoid obstacles. In case of any obstacles that may not be avoided, the machine vision system may stop running and give a prompt. If a person enters a range of the movement trajectory of the iron roughneck, the machine vision system may automatically stop running.

The control system may automatically adjust the height of the iron roughneck to match the height of the joint between the first stand and the second stand. The control system may automatically control the make-up torque to make up the first stand to fasten the first stand and the second stand, so as to prevent the operator from frequently confirming the position information of the iron roughneck, thereby shortening the operating time, improving work efficiency, and reducing safety risks for the operator. When conducting the step 6, the iron floor man may be moved to a stand-by position for the next stand, for example, moving the iron floor man back to its initial position to prepare for grabbing the next stand, and the pipe racking device may begin to grab the next stand in the set back area. When finishing the step 6, the iron roughneck may be moved to a parking position, for example, moving the iron roughneck back to its initial position to prepare for a next stabbing operation.

In step 7, the traveling block may be moved downward. The power slip may be turned on and the traveling block may be moved downward to a preset position. Then the power slip may be turned off. In the step 7, in order to facilitate an opening of the power slip, the traveling block may move upward for a certain distance at first, and meantime the power slip may be opened, so that a pulling force exerted by the traveling block on the stand may be used to balance the gravity of the stand, thereby releasing the load on the power slip, which may make it easier to open the power slip. When the traveling block is moving upward, the third smart detection module may transmit an observed signal (e.g., an image obtained by the image acquisition device, distance information regarding the drilling device and the pipe guiding arm) to the machine vision system, thereby ensuring a safe operation of the traveling block. Before the step 8 is executed, the pipe racking device may have grabbed the next stand.

In step 8, the traveling block may be moved upward. In some embodiments, relative position information of the power elevator and the stand may be obtained using the position detection technique or the machine vision technique. The control system may be used to disengage the power elevator from the stand, thereby moving the traveling block upward to the second waiting position of the racking platform.

The control system may control a power elevator link to incline to separate the power elevator from the stand, and then make the traveling block move upward to the second waiting position of the racking platform, and make the power elevator link return to a gesture before inclining during moving upward the traveling block. When the traveling block is moved upward, the relative position information of the power elevator and the stand may be obtained using the position detection technique or the machine vision technique, and the control system may control the power elevator link to incline to pull an upper end of the stand out of the power elevator link. At this time, the power elevator and the stand may be separated. Then, the traveling block may be moved upward to the second waiting position of the racking platform, so as to ensure the power elevator is completely separated from the stand. In some embodiments, the relative position information of the power elevator and the stand may be obtained by a fourth smart detection module. For example, if a distance between the power elevator and the stand is greater than a distance threshold, the power elevator and the stand may be considered to be completely separated. Exemplary distance threshold may include 0.2 m, 0.5 m, etc., which is not limited. Then the traveling block may be moved upward without frequently determining the relative position information of the power elevator and the stand by the operator.

In some embodiments, the steps 4-8 may be repeatedly performed to continually running the stands into the wellbore.

Therefore, the method for running the drilling rig or the workover rig into the wellbore in the present disclosure may realize an automatic control of the whole process 100, thereby improving the processing efficiency. The machine vision technique and the position detection technique may reduce a lot of manual operations during the process 100 and avoid frequent manual confirmation as to stand jointing, thereby reducing safety risks for the operator.

Figure 2:
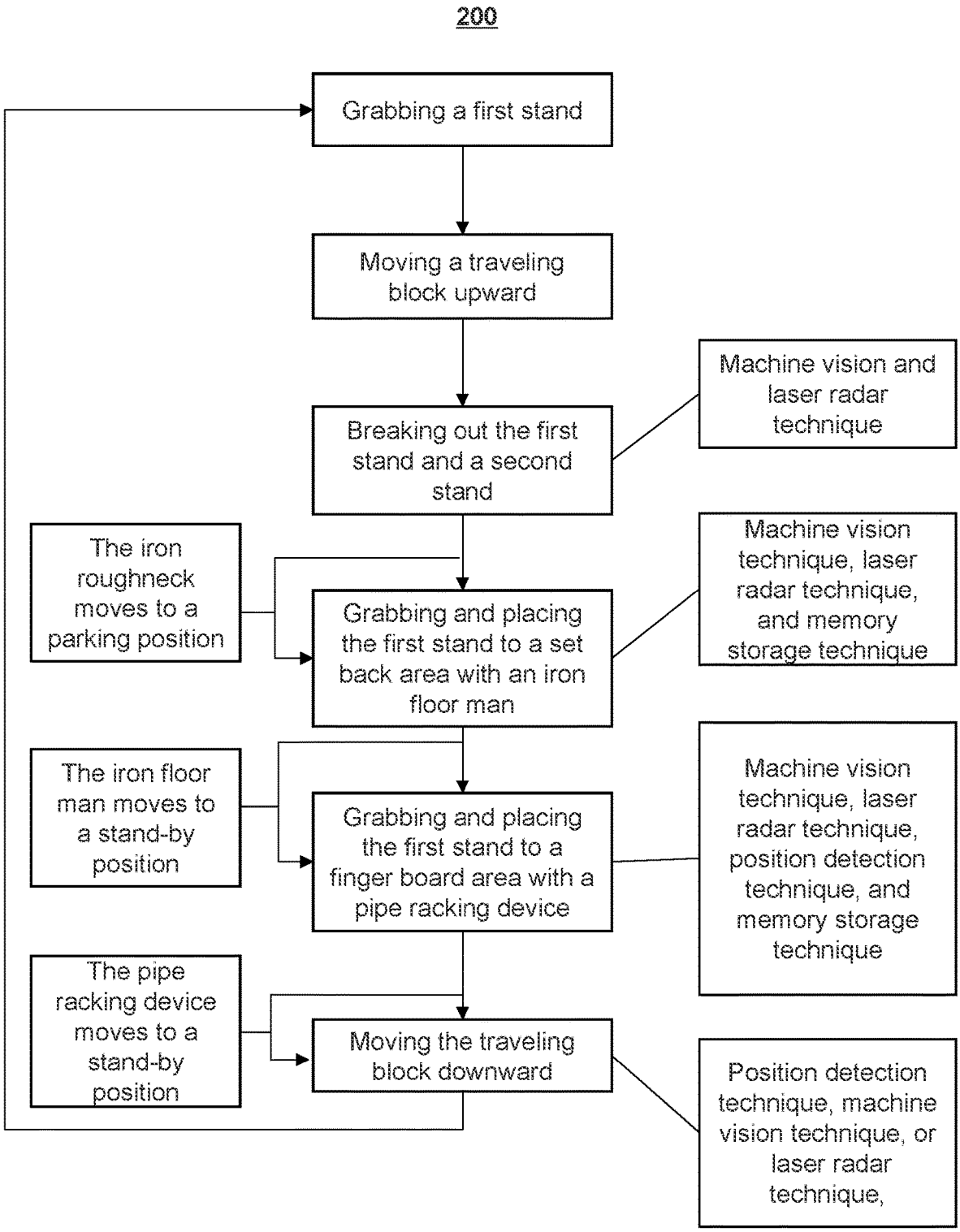
FIG. 2 is a block diagram illustrating an exemplary process for pulling a drilling rig or a workover rig out of a wellbore according to some embodiments of the present disclosure.

FIG. 2 is a block diagram illustrating an exemplary process for pulling a drilling rig or a workover rig out of a wellbore according to some embodiments of the present disclosure. The drilling rig or the workover rig may include a plurality of stands (e.g., a stand 330 shown in FIG. 3).

Process 200 may include the following steps. As used the process 200, a first stand and a second stand may be any two jointed stands of the plurality of stands, wherein a bottom end of the first stand is stabbed in an upper end of the second stand and a joint between the first stand and the second stand is made up.

In step 1, the first stand of the plurality of stands may be grabbed. When a power elevator (e.g., a power elevator 320) contacts a step surface of the stand, the power elevator may be turned off and seize the first stand.

In some embodiments, a first stand of the plurality of stands may be placed in a well center, and a power slip (e.g., a power slip 370) may be turned off. When the power elevator contacts the step surface of the first stand, the power elevator may be turned off and seize the first stand. In some embodiments, the machine vision system may observe a position of the traveling block, and transmit the position to the control system. The control system may turn off the power elevator and make the power elevator seize the first stand. The third smart detection module may observe a movement trajectory of the traveling block to avoid the traveling block from intervening other devices, thereby ensuring a safe operation of the traveling block. The second smart detection module may detect a distance between the power elevator and the traveling block. The machine vision system may determine whether the power elevator seizes the first stand firmly. In response to a determination that the power elevator seizes the first stand firmly, the traveling block may be moved upward.

In step 2, the traveling block may be moved upward. The power slip may be turned on to make the traveling block move upward. When the traveling moves to a target height, the power slip may be turned off.

In some embodiments, after the power slip is turned on, the control system may adjust the traveling block to move upward slowly. The second smart detection module may determine whether there is a relative displacement of the first stand and the power elevator. If there is the relative displacement, the power elevator may not seize the first stand firmly. If the first stand keeps still relative to the power elevator, the power elevator may seize the first stand firmly. When the power elevator seizes the first stand firmly, the control system may control the traveling block to move upward to the target height.

In step 3, the first stand and a second stand of the plurality of stands may be broken out. A bottom end of the first stand may be stabbed in an upper end of the second stand, and a joint between the first stand and the second stand may be made up. Position information of a tong body of an iron roughneck (e.g., an iron roughneck 360 shown in FIG. 3) may be obtained using the machine vision technique. Position information of a joint between the first stand and the second stand may be obtained using the machine vision technique. The control system may make a height of the tong body of the iron roughneck match a height of the joint between the first stand and the second stand, by automatically adjusting the height of the tong body of the iron roughneck. The first stand and the second stand may be broken out. Meantime, position information of the first stand and the second stand may be obtained using the machine vision technique and transmitted to the control system. The control system may determine whether the first stand and the second stand are broken out.

After the traveling block moves to the target height, the iron roughneck may be extended to broke out the first stand and the second stand that have been made up. By using the machine vision technique, the position information of the tong body of the iron roughneck and the position information of the joint may be obtained. In some embodiments, the second smart detection module may determine the position information of the joint. The control system may automatically adjust the height of the iron roughneck, so as to make the height of the tong body of the iron roughneck match the height of the joint and to break out the first stand and the second stand.

Meantime, the position information of the first stand and the second stand may be obtained using the machine vision technique. For example, the second smart module may obtain information of the joint and transmit it to the control system. The system may determine whether the first stand and the second stand are broken out, which may avoid the operator from frequently confirming the position information of the iron roughneck and frequently determining whether the first stand and the second stand are broken out, thereby reducing work time, improving working efficiency, and reducing safety risks for the operator.

In step 4, the first stand may be grabbed and placed to a set back area with an iron floor man (e.g., an iron floor man 350 shown in FIG. 3). The first stand may be grabbed and a bottom end of the first stand may be placed to the set back area with the iron floor man in a set back area.

After breaking out the first stand and the second stand, position information of the iron floor man and the position information of the joint may be obtained through the second smart detection module and transmitted to the control system. The control system may control the iron floor man to extend to the joint, grab the first stand above the second stand, and place the first stand to the set back area.

In some embodiments, the machine vision system may further include a fifth smart detection module that is provided on a drill floor pipe handling device or a drill floor. The drill floor pipe handling device may be used to dock and arrange a drill floor pipe on the drill floor. In some embodiments, the drill floor pipe handling device may include the iron floor man and the iron roughneck. The fifth smart detection module may determine a position for placing a bottom end of a stand (e.g., the first stand) and transmit the position to the control system. The control system may control a movement trajectory of the iron floor man, and push the bottom end of the stand to the position for placing the bottom end of the stand, i.e., the set back area.

In some embodiments, the fifth smart detection module may include but not limited to an image acquisition device, a laser radar, and a millimeter-wave radar. The operational principle of the fifth smart detection module may be similar to that of the second smart detection module and the fourth smart detection module, which is not repeated herein.

When conducting the step 4, the iron roughneck may be moved to a parking position, for example, the iron roughneck may be moved back to its initial position.

In step 5, the first stand may be grabbed and placed to a finger board area with a pipe racking device (e.g., a pipe racking device shown in FIG. 3). The first stand may be grabbed with the pipe racking device. Relative position information of the first stand and a tong body of the pipe racking device may be obtained using the machine vision technique. The control system may make an upper end of the first stand be placed in a finger board area by automatically adjusting a position of the tong body of the pipe racking device.

After the iron floor man places the grabbed first stand in the finger board area, the pipe racking device may begin to grab the first stand. After the pipe racking device grabs the first stand, the power elevator may be turned on to disengage the first stand from the power elevator. The upper end of the first stand may be placed in the finger board area. The first stand grabbed with the iron floor man and the first stand grabbed with the pipe racking device may be the same stand. In some embodiments, after the pipe racking device grabs the first stand, the first stand may be tilted to facilitate being pushing to the finger board area. In some embodiments, after the pipe racking device grabs the first stand, the first stand may be adjusted to a vertical state, and then moved to the finger board area.

In some embodiments, using the machine vision technique, the fourth smart detection module may obtain the position information of the first stand and the position information of the pipe racking device, and transmit it to the control system. The control system may automatically adjust the tong body of the pipe racking device, which may avoid the operator from frequently determining the position information of the first stand and the position information of the pipe racking device, thereby reducing safety risks for the operator, reducing work time, and improving working efficiency. When conducting the step 5, the iron floor man may be moved to a stand-by position, for example, moving the iron floor man to its initial position to prepare for grabbing a next stand (e.g., the second stand).

As described above, when pulling the stand(s) out of a wellbore, each stand may be moved back to its original position. For example, before being run into the wellbore, the first stand may be placed at a first position in a placement area (e.g., a position at the front of the placement area), and the second stand may be placed at a second position in the placement area (e.g., a position next to the first position). As described in FIG. 1, the placement area may include the finger board area and a set back area, wherein an upper end of a stand may be pushed to the finger board area, and a bottom end of the stand may be pushed to the set back area. After being pulled out of the wellbore, the first stand may be moved back to the first position, and the second stand may be moved back to the second position. Through making the positions of the stands in the placement area be a fixed position, the information relating to a plurality stands, which may be tripped in sequence, may be obtained. In this way, in case of any fault, the faulty stand may be accurately determined according to the information relating to the plurality stands, which is convenient for directly handling or replacing the faulty stand during a maintenance operation, thereby simplifying the maintenance operation and saves a maintenance cost.

In the steps 4 and 5, the control system may obtain the sequence number of the stands, which may be recorded in the process for running the drilling rig or the workover rig into the wellbore. The control system may control the iron floor man and the pipe racking device to move to a position in the placement area corresponding to the sequence number by applying the machine vision technique. In some embodiments, the first smart detection module may determine the position of a stand (e.g., the first stand) in the placement area.

In order to make the pipe racking device seize the first stand firmly, during the pipe racking device grabs the first stand, the control system may simultaneously use the position detection technique and the machine vision technique to make one or more minor adjustments to an open direction of the power elevator.

In some embodiments, the fourth smart detection module may determine the open direction of the power elevator, the position information of the first stand, the position information of the pipe racking device, and transmit to the control system. The control system may be used to make one or more minor adjustments to the open direction to face to a direction of the first stand, so as to make the first stand enter into the power elevator.

In step 6, the traveling block may be moved downward. Position information of the power elevator may be obtained using a position detection technique or the machine vision technique. The traveling block may be moved downward through the control system by controlling an angle of inclination of the power elevator, so as to grab a next stand.

In some embodiments, the machine vision system may include the third smart detection module disposed on a mast. The third smart detection module may be used to observe a relative distance regarding a drilling device such as the traveling block and the power elevator and a pipe guiding arm, so as to ensure a safe operation of the traveling block.

In the process for tripping the drilling rig or the workover rig or other operations, the vision modules in the present disclosure may be used to reconstruct a real-time 3D image in the area of each vision module. During the operation of each device, the control system may construct the real-time 3D image based on each vision module, and determine and adjust a movement trajectory of each device, thereby completely avoiding accidents such as collision of different devices. In addition, the various vision modules may detect whether a person enters a dangerous area or is within a range of the movement trajectory of the devices, and stop the operation of the device or issue an alarm to remind the person to leave in time, thereby improving the safety of the system.

In some embodiments, the steps 1-6 may be repeatedly performed to continually pulling the stands out of the wellbore.

Therefore, the method for pulling the drilling rig or the workover rig out of the wellbore in the present disclosure may realize an automatic control of the whole process 200, improve the processing efficiency, and reduce safety risks for the operator. In addition, when conducting the step 6, the pipe racking device may be moved to a stand-by position, for example, moving the pipe racking device back to the first waiting position, so as to prepare for grabbing the next stand.

FIG. 3 is a schematic diagram illustrating an exemplary drilling rig 300 according to some embodiments of the present disclosure. As shown in FIG. 3, the drilling rig 300 may include a racking platform ad pipe racking device 310, a power elevator 320, a stand 330, a pipe guiding arm 340, an iron floor man 350, an iron roughneck 360, a power slip 370, and a drawworks 380. In some embodiments, the power elevator 320 may be pulled to move in a vertical direction via a traction rope by the drawworks 380.

In conclusion, the present disclosure may include at least the following beneficial effect, including: (1) In the process for tripping the drilling rig or the workover rig, an automatic control of the whole process may be achieved, thereby improving the efficiency for handling the drilling rig or the workover rig and reducing a cost for the drilling rig or the workover rig; (2) The operator may be avoided from frequently confirming stand jointing, thereby reducing safety risks for the operator and improving the safety of the pipe; (3) A large amount of manual auxiliary operation may be reduced, thereby reducing the labor strength of the operator; (4) A count of the operators may be reduced.

We claim:

1. A method for running a drilling rig or a workover rig into a wellbore, wherein the drilling rig or the workover rig include a plurality of stands, the method comprising:

step 1, recording position information and sequence numbers of the plurality of stands that are placed in a finger board area with a control system, and placing a pipe racking device in a first waiting position, wherein the position information is provided by a first smart detection module which is disposed on a mast and close to a racking platform, and the sequence numbers are determined according to the position information by the first smart detection module;

step 2, placing the stands, including: identifying relative position information regarding a first stand and a well center with a second smart detection module, and placing the first stand of the plurality of stands in the well center, and grabbing a second stand of the plurality of stands from the finger board area with the pipe racking device;

step 3, determining a relative distance between a traveling block and a pipe guiding arm with a third smart detection module arranged on a mast, and adjusting the relative distance between the traveling block and the pipe guiding arm to be greater than a preset threshold to avoid interference between the traveling block and the pipe guiding arm, so as to move a power elevator to a second waiting position of the racking platform, wherein the second waiting position is a position that is docked with the stands grabbed with the pipe racking device;

step 4, pushing the stands into the power elevator with the pipe racking device, including:

obtaining relative position information regarding the power elevator and the second stand, recognizing an open direction of the power elevator and the direction of the second stand using a fourth smart detection module, making one or more minor adjustments to the open direction of the power elevator until the power elevator faces toward the direction of the second stand, and pushing an upper end of the second stand to the power elevator with the pipe racking device through the control system by automatically adjusting a position of a tong body of the pipe racking device;

step 5, moving and stabbing the second stand in the first stand with an iron floor man, including: grabbing the second stand and stabbing a bottom end of the second stand in an upper end of the first stand that is placed in the well center with the iron floor man;

step 6, making up a joint between the first stand and the second stand, including:

extending an iron roughneck, obtaining position information of the iron roughneck using the second smart detection module, obtaining position information of the joint between the first stand and second stand using the second smart detection module, making a height of a tong body of the iron roughneck match a height of the joint through the control system by automatically adjusting the height of the tong body of the iron roughneck, and making up the joint between the first stand by using the control system to automatically adjust a make-up torque;

step 7, moving the traveling block downward; and step 8, moving the traveling block upward, including:

obtaining relative position information of the power elevator and a stand using a position detection technique or the fourth smart detection module, and using the control system to disengage the power elevator from the stand, thereby moving the traveling block upward to the second waiting position of the racking platform.

2. The method of claim 1, wherein the step 4 further includes making the second stand enter into the power elevator by using the control system to make one or more minor adjustments to an open direction of the power elevator by simultaneously applying the position detection technique and the fourth smart detection module.

3. The method of claim 1, wherein the step 5 further includes:

obtaining position information of the second stand in a placement area, the placement area including the finger board area and a set back area, and automatically recording the second sequence number of the second stand and the position information of the second stand in the placement area.

4. The method of claim 1, further comprising:

when finishing the step 5, moving the pipe racking device to a stand-by position for a next stand, when conducting the step 6, simultaneously moving the iron floor man to a stand-by position for the next stand, making the pipe racking device grab a next stand, and grabbing the next stand before the step 8, and when finishing the step 6, moving the iron roughneck to a parking position.

5. The method of claim 1, further comprising continually running the stands into the wellbore by repeatedly performing the steps 4-8.

6. A method for pulling a drilling rig or a workover rig out of a wellbore, wherein the drilling rig or the workover rig include a plurality of stands, the method comprising:

step 1, grabbing a first stand of the plurality of stands, including: when a power elevator contacts a step surface of the first stand, turning off the power elevator and making the power elevator seize the first stand;

step 2, moving a traveling block upward, and determining whether there is a relative displacement of the first stand and the power elevator using a second smart detection module;

step 3, breaking out the first stand and a second stand of the plurality of stands, a bottom end of the first stand being stabbed in an upper end of the second stand, a joint between the first stand and the second stand being made up, including:

obtaining position information of a tong body of an iron roughneck using the second smart detection module, obtaining position information of the joint between the first stand and the second stand using the second smart detection module, making a height of the tong body of the iron roughneck match a height of the joint between the first stand and the second stand, through the control system automatically adjusting the height of the tong body of the iron roughneck, breaking out the first stand and the second stand, and meantime, obtaining position information of the first stand and the second stand using the second smart detection module and transmitting to the control system, and determining whether the first stand and the second stand are broken out through the control system;

step 4, grabbing and placing the first stand with an iron floor man, including: transmitting position information of the iron floor man and position information of the joint obtained by the second smart detection module after breaking out the first stand and the second stand to the control system, determining a position for placing a bottom end of the first stand and transmitting the position to the control system with a fifth smart detection module, grabbing the first stand from the bottom end of the first stand and placing the bottom end of the first stand to a set back area with the iron floor man;

step 5, grabbing and placing the first stand with a pipe racking device to a finger board area, including:

grabbing the first stand with the pipe racking device, obtaining relative position information regarding the first stand and a tong body of the pipe racking device with a fourth smart detection module, moving an upper end of the first stand to the finger board area through the control system automatically adjusting a position of the tong body of the pipe racking device, and step 6, moving the traveling block downward, including:

obtaining position information of a power elevator link using a position detection technique or the fourth smart detection module, and moving the traveling block downward through the control system controlling an angle of inclination of the power elevator link, so as to grab a next stand wherein: during the process for pulling the drilling rig or the workover rig out of the wellbore, observing a relative distance regarding the traveling block and a pipe guiding arm with a third smart detection module arranged on a mast, and adjusting the relative distance between the traveling block and the pipe guiding arm to avoid interference between the traveling block and the pipe guiding arm, detecting a distance between the power elevator and the traveling block with the second smart detection module.

7. The method of claim 6, wherein the steps 4 and 5 further include:

obtaining a sequence number of the first stand and position information of the first stand in the placement area by the control system, the placement area including the finger board area and a set back area, and using the machine vision technique, placing the first stand at a position corresponding to the sequence number and the position information of the first stand by using the control system to control the iron floor man and the pipe racking device.

8. The method of claim 6, wherein the step 5 further includes making the pipe racking device grab the first stand firmly by using the control system to make one or more minor adjustments to an open direction of the power elevator by simultaneously applying the position detection technique and the machine vision technique.

9. The method of claim 6, further comprising:

when conducting the step 4, moving the iron roughneck to a parking position;

when conducting the step 5, moving the iron floor man to a stand-by position;

when conducting the step 6, moving the pipe racking device to a stand-by position.

10. The method of claim 6, further comprises continually pulling the stands out of the wellbore by repeatedly performing the steps 1-6.

* * * * *